United States Patent [19]

Pounds

[11] 4,113,114

[45] Sep. 12, 1978

[54] METHOD AND APPARATUS FOR RAILROAD CAR SHUNTING

[76] Inventor: William J. Pounds, 155 Velvet Dr., Jacksonville, Fla. 32220

[21] Appl. No.: 777,032

[22] Filed: Mar. 14, 1977

[51] Int. Cl.[2] ..... B61G 5/00

[52] U.S. Cl. ..... 213/75 R; 105/26 R; 105/73; 105/75; 213/112; 214/620

[58] Field of Search ..... 214/152, 330, 331, 620; 105/26 R, 73, 75; 213/75 R, 111, 112, 224

[56] References Cited

U.S. PATENT DOCUMENTS

| | | | |
|---|---|---|---|
| 2,722,897 | 11/1955 | Morey | 105/73 |
| 3,207,085 | 9/1965 | Burr | 105/73 X |
| 3,258,146 | 6/1966 | Hamilton | 214/331 X |
| 3,709,153 | 1/1973 | Herscovitch | 105/26 R |
| 3,940,167 | 2/1976 | Pilz | 280/456 R |

*Primary Examiner*—L. J. Paperner

*Attorney, Agent, or Firm*—George H. Baldwin; Arthur G. Yeager

[57] ABSTRACT

An interconnected series of in excess of twenty-five railroad cars may be shunted about a yard by attaching a vertically displaceable carriage of a forklift truck to the coupler of the first car in the series through a load bearing coupling adaptor and raising the forklift carriage until a sufficient portion of the weight of the railroad car is transferred to the driving wheels of the forklift to give the forklift sufficient traction to move the series of railroad cars.

A load-bearing coupling adaptor suitable for such load-bearing attachment of railroad car coupler to fork-lift carriage may be fabricated from a means for rigidly mounting to the fork-lift truck, a coupling pin means for securingly engaging the coupler interiorly of said coupler, and a load-bearing member rigidly connecting the means for mounting to the coupling pin means and extending therebetween at a level beneath said coupler. Means for aligning the means for mounting with the carriage and means for aligning the coupling pin means interiorly of the coupler may also be provided.

11 Claims, 7 Drawing Figures

METHOD AND APPARATUS FOR RAILROAD CAR SHUNTING

BACKGROUND OF THE INVENTION

This invention relates principally to the railroad industry and specifically to the shunting of railroad cars.

As is well known to those skilled in the art, a railroad car such as a boxcar, flatcar, or the like, may spend as much or more time in a railroad facility being loaded, unloaded, or repaired, than it spends in actual use transporting goods between their point of origin and destination. During this time in the facility the railroad car must be moved about the yard either by itself or in combination with other similar cars in order to be loaded, unloaded, repaired, or stored until a fully marshalled series of railroad cars is ready to be assembled, connected to an engine and moved out. Since the vast majority of railroad cars are not individually powered, moving the cars about a yard, repair facility or loading warehouse, generally necessitates the use of some form of motorized device.

In major railroad yards where a great amount of such intra-yard movement is experienced, large shunt engines are used specifically for this purpose. In smaller facilities, however, where such movement is done less frequently, such as in an industrial yard or on a "spot-rip" track, the use of such a large shunt engine may be impractical either due to limited maneuvering space within the facility or due to the large expense involved in the purchase and maintenance of such a device. In such cases, various machines may be utilized to move railroad cars which machines have primary uses which differ substantially from the moving of railroad cars. Almost invariably these machines must be used in a mode for which they were not intended. As a result of such use, the safety factor, which may be within permissable limits for the primary use of the machine, may be reduced or eliminated. Under such circumstances, the danger to personnel and equipment is increased, in many cases, beyond reasonable limits.

Among such alternative methods which have been used is that of positioning a mobile loading crane, which is capable of movement alongside a railroad track, close to a railroad car, lowering the boom of the crane so that the bottom end is in contact with the side or the end of the boxcar, and driving the crane towards the desired destination, literally pushing the railroad car along the track. Such a method is inherently dangerous both because the boom end may slip from its contact with the car and also because, once in motion, the railroad car cannot be stopped by the crane. In order to stop the moving car, blocks or "chocks" must be maneuvered by other workers into the path of the car along the tracks at the desired stopping point.

It is also known to use a relatively small motorized device such as a forklift truck in combination with a cable, chain or the like in order to pull a boxcar to its desired destination in the yard. The use of this method, however, is limited both because of a stopping problem similar to that experienced in the use of the crane, and because a conventional forklift has always previously been found to be incapable of pulling more than one or two cars at a time. Finally, some mining operations use front end loaders to push the railroad cars in a manner similar to that used with the mobile cranes.

As is evidenced by the foregoing, it would be desirable to provide a safe method of shunting railroad cars under circumstances in which the use of a shunt engine is either impossible or impractical.

In addition, it would be desirable if such a method could be practiced with a device having other uses in that yard.

Finally, it would be desirable that such method and apparatus minimize or eliminate the possibility of personal injury or property damage resulting from their use.

SUMMARY

It has now been discovered that a series of in excess of twenty-five railroad cars may be shunted about a railroad facility by a method in which the lifting carriage of a conventionally powered forklift truck is attached, by a load-bearing coupling adaptor, to the coupler of the first car in the series in such a way as to allow the forklift carriage to be raised into a position in which a sufficient portion of the weight of the boxcar is transferred through the adaptor to the driving wheels of the forklift truck to give it sufficient traction to pull the series of cars. As a result of the use of this method, the driving wheels of the forklift are supplied with sufficient traction not only for starting the series of cars in motion, but also for safely and effectively stopping the series of cars once in motion.

A load-bearing coupling adaptor suitable for the interconnection of the forklift carriage with the coupler of the railroad car may comprise a first vertically upstanding rectangular plate having a top edge, a bottom edge, a carriage-facing edge, a coupler-facing edge, and two rectangular planar sides, the first rectangular plate having a first transverse carriage-mounting groove in the bottom edge adjacent the carriage-facing edge and a superposed second transverse carriage-mounting groove in the top edge adjacent the carriage-facing edge, an elongated load-bearing member rigidly mounted to the coupler-facing edge and extending outwardly therefrom substantially in the plane of the first rectangular plate, an elongated vertically upright coupling pin rigidly mounted adjacent the bottom end thereof to the outwardly extending end of the load bearing member. The coupling adaptor may also be provided with an alignment wing rigidly mounted to the coupling pin adjacent its upper end and extending outwardly therefrom in a plane substantially normal to the plane of said first rectangular plate, and an elongated alignment bar rigidly mounted at a point intermediate its length to the top edge of, and substantially normal to the plane of, the first rectangular plate, immediately adjacent the transverse groove on the side thereof closest to the load-bearing member.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DESCRIPTION OF THE PREFERRED EMBODIMENT

Figure 1:
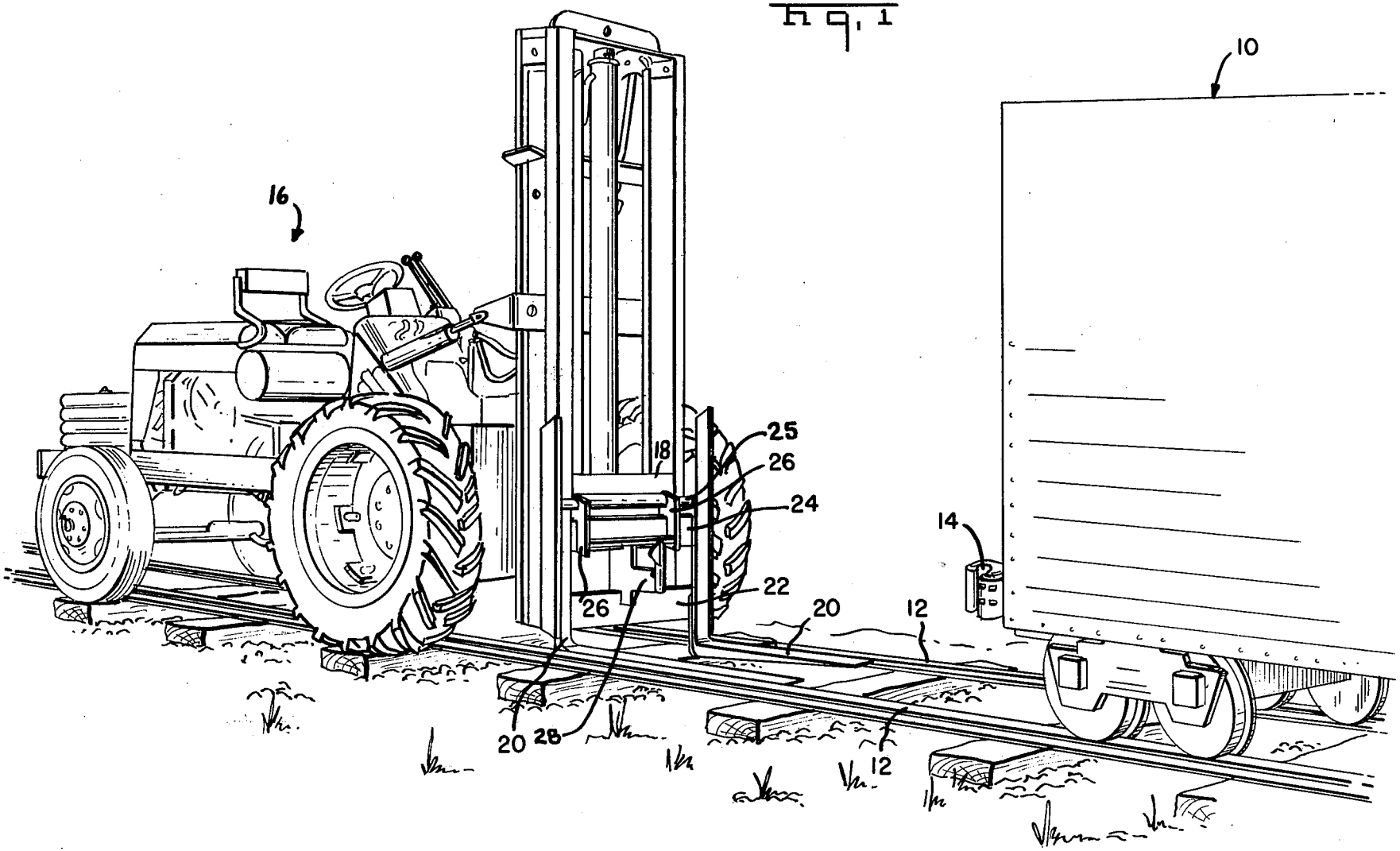
FIG. 1 is a perspective view of an apparatus constructed in accordance with a portion of this invention mounted to a carriage of a forklift truck.

Referring to FIG. 1, there is seen the general apparatus necessary to perform the method of this invention. The conventional railroad car 10, moveably mounted on parallel tracks 12 is equipped with coupler 14. A conventional forklift truck, indicated generally at 16, is equipped with a vertically displaceable lift carrigae 18 carrying a pair of horizontally extending forks 20, all as is well known to those skilled in the art. The conventional vertically displaceable lift carriage 18 of a forklift truck includes a lower support cross-member 22 and an upper support cross-member 24 each of which is horizontally oriented and rigidly mounted to the vertically displaceable lifting carriage 18 in superposed parallel spaced relation to each other. Also rigidly mounted to the lifting mechanism are two parallel, spaced, vertically oriented support members 26 which extend downwardly from a position above upper support cross-member 24 to a position adjacent the lower boundary thereof and which extend outwardly therefrom. Elongated fork mounting bar 25 is pivotally mounted to vertical support members 26 at points thereon above upper support cross-member 24 and extends horizontally to either side of the lifting apparatus. "L" shaped fork members 20 are rigidly mounted to elongated fork mounting bar 25, one adjacent either end of bar 25, such that the vertical portions of the forks rest against cross-members 22 and 24 and the horizontal portions of the forks extend outwardly from the lift carriage. Finally coupler member 28, further described herein below, is releasably mounted to fork-lift carriage 18 between cross-members 22 and 24, and is held in a generally vertical orientation by support members 26.

Figure 2:
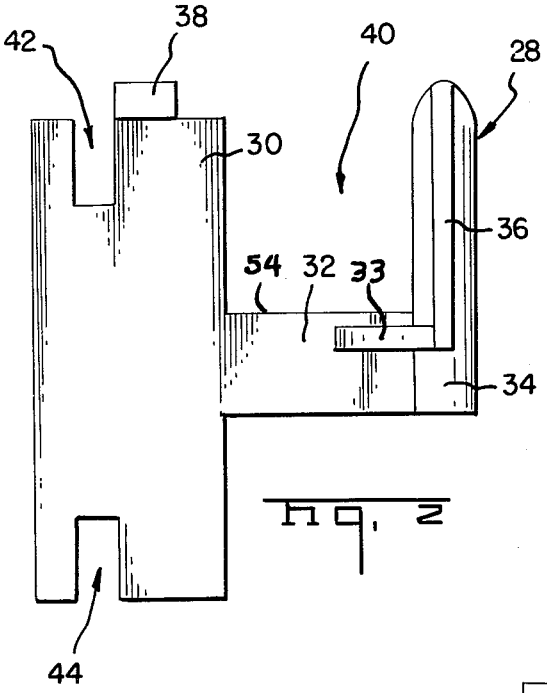
FIG. 2 is a side elevational view of a coupling device constructed in accordance with the invention.
Figure 3:
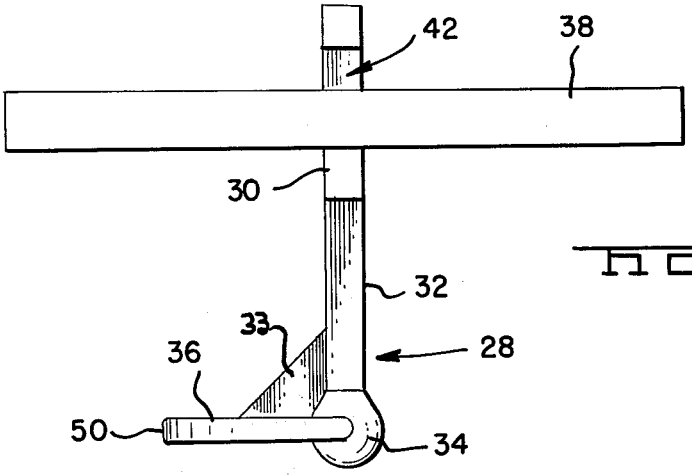
FIG. 3 is a top plan view of the device shown in FIG. 2.
Figure 4:
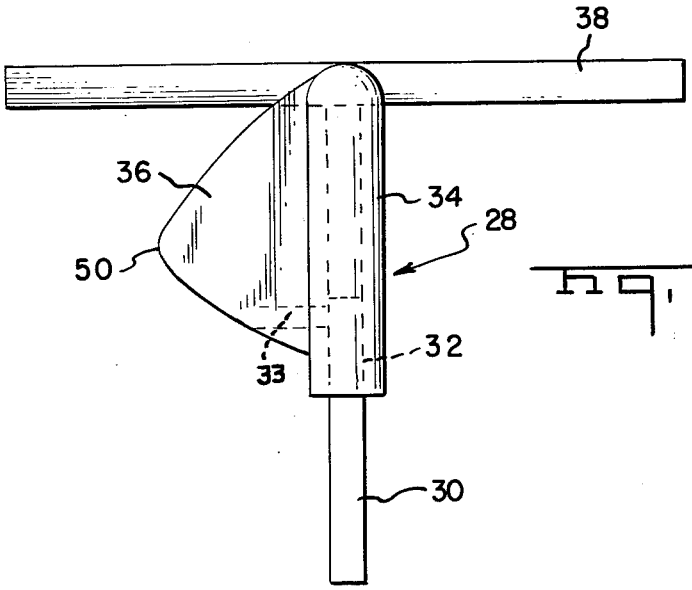
FIG. 4 is a front elevational view of the device shown in FIGS. 2 and 3.

Referring to FIGS. 2, 3 and 4, there are seen side, top, and front views of coupler 28 in a slightly expanded scale. As shown in the FIGS., coupler 28 comprises, generally, a means for mounting such as a first vertically upstanding rectangular plate 30, having a top edge, a bottom edge, a carriage facing edge, a coupler facing edge and two rectangular planar sides, a load bearing member such as second rectangular plate 32, a coupling pin means such as cylindrical coupling pin 34, an alignment wing means such as generally triangular alignment wing 36, and an alignment bar means such as elongated alignment bar 38. Cylindrical coupling pin 34 is held in spaced relation to first rectangular plate 30 by second rectangular plate 32, in such a way as to form a channel 40 between the cylindrical member and the first rectangular member capable of accomodating a knuckle of a railroad car coupler as further described below. First rectangular plate 30 has an transverse carriage-mounting groove 42 fromed in its top edge and a transverse carriage-mounting groove 44 formed in its bottom edge. Upper groove 42 and lower groove 44 are superposed adjacent the carriage-facing edge and are constructed having such depth and distance therebetween as to releasably mount to the forklift device as further described hereinbelow. Alignment bar 38 is rigidly mounted adjacent the side of groove 42 closest to the coupler and extends outwardly on either side of first rectangular plate 30 normal thereto. Triangular alignment wing 36 extends outwardly from the top of cylindrical coupling pin 34 and in a plane perpendicular to the plane defined by second rectangular member 30 and coupling pin 34. A brace means 33 is preferably rigidly mounted between alignment wing 34 and load-bearing member 32.

Figure 5:
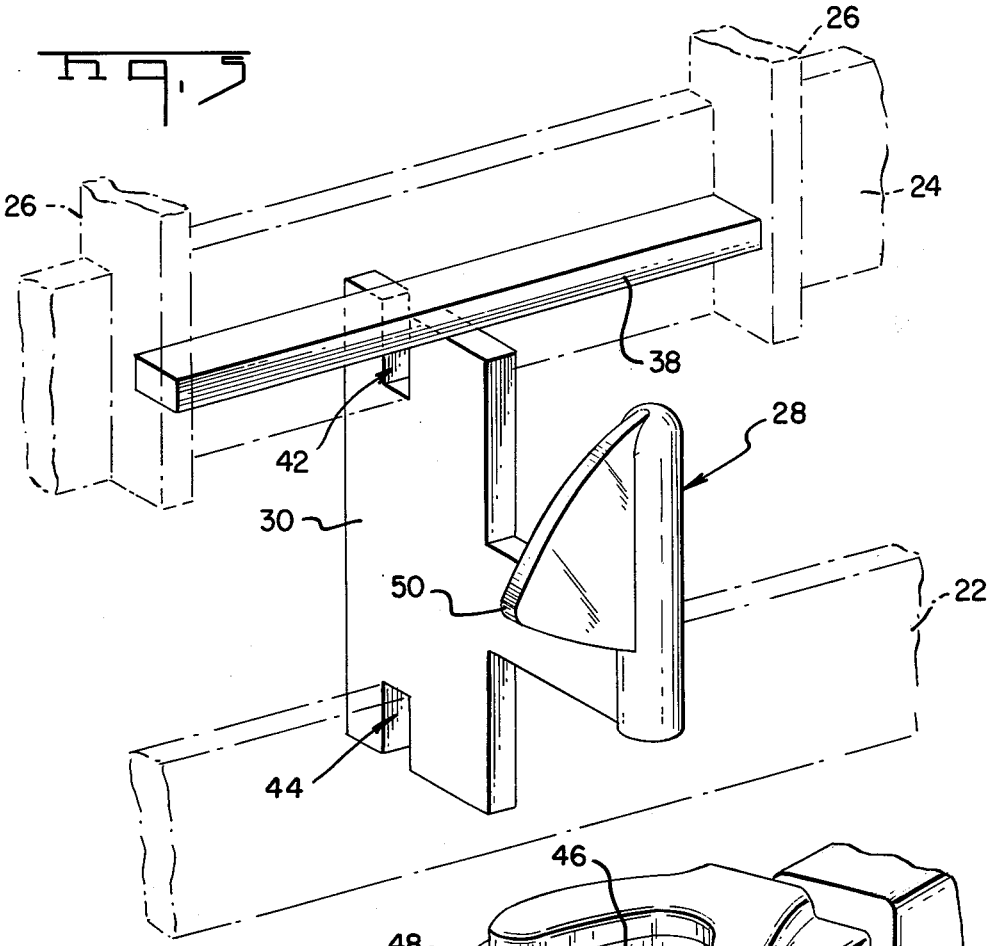
FIG. 5 is a perspective view on a slightly reduced scale of the device shown in FIGS. 2, 3 and 4, attached to the carriage of a forklift truck.

FIG. 5 shows coupling device 28 as mounted to support members 22 and 24 of forklift carriage 18. In order to mount the coupling device 28 to the vertically displaceable carriage, the device is tilted to one side and placed between the horizontal support members 24 and 22 until transverse grooves 42 and 44 are aligned respectively therewith. The coupling device is then returned to a vertical position such that upper support member 24 is inserted in upper transverse groove 42 and lower support member 22 is inserted in lower transverse groove 44. In so doing elongated alignment bar 38, being immediately adjacent slot 42, is brought adjacent to upper support member 24 and between vertical members 26 in such a way as to stabilize coupling adaptor 28 with respect to side-to-side movement.

As is well known to those skilled in the art, a conventional e-type railroad car coupler comprises a rigid, generally "U" shaped member having a central hollow. Attached to one side of the "U" adjacent its end is a knuckle which is pivotably mounted to said coupler and which has a locking means for maintaining the knuckle in a closed position. Thus when two railroad cars are coupled together, the knuckles are locked in closed position thereby maintaining the connection. As is also well known to those skilled in the art, a conventional f-type coupler consists of generally the same elements as an e-type coupler, but, additionally carries a lower shelf horizontally disposed beneath a portion of the central hollow of the coupler and spaced a distance therebelow leaving a gap between the bottom of the knuckle and the shelf.

Figure 6:
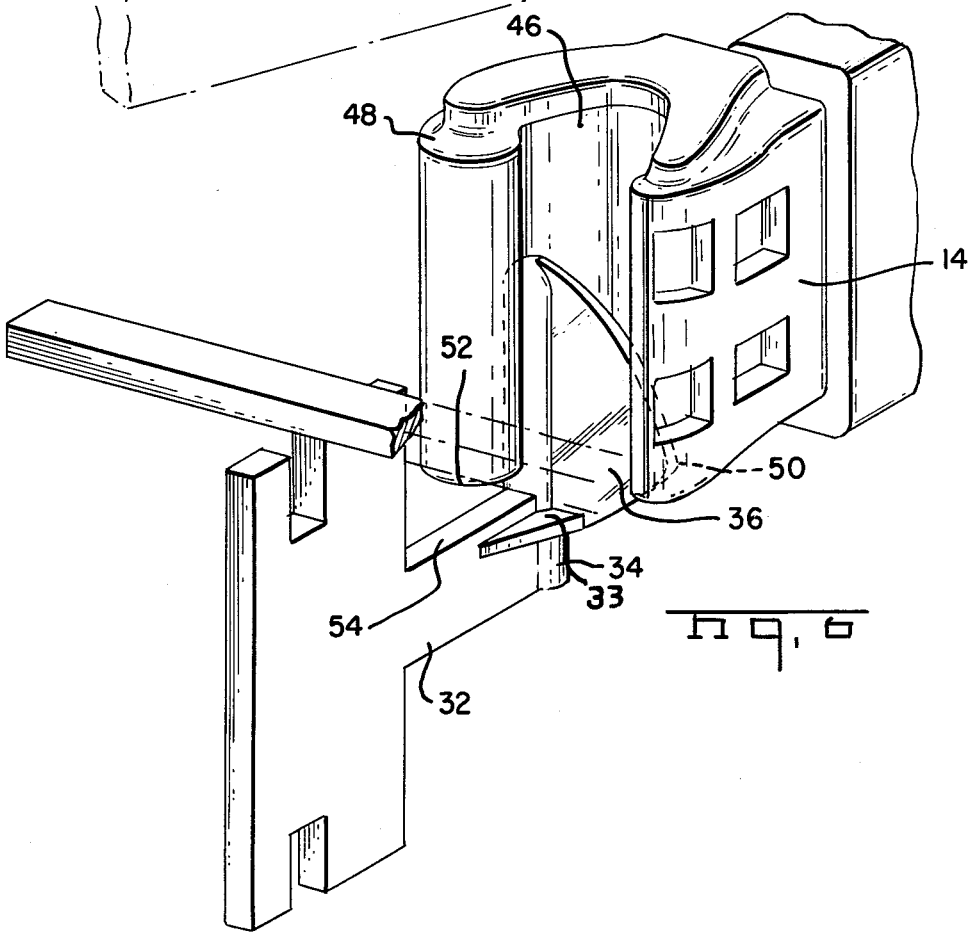
FIG. 6 is a perspective view on a scale similar to that of FIG. 5 of the coupling device as attached to an e-type coupler of a railroad car.

Referring to FIG. 6 there is seen a coupling adaptor 28 as attached to a conventional e-type railroad car coupler. As seen therein cylindrical member 34 and triangular alignment wing 36 are inserted within central hollow 46 of railroad car coupler car 14. Alignment wing 36 is sized and shaped such that its outermost apex 50 impinges upon the interior of central hollow 46 sufficiently to cause cylindrical coupling pin 34 to be retained in position behind coupler knuckle 48, and to cause load-bearing member 32 to be maintained beneath the bottom 52 of knuckle 48.

Figure 7:
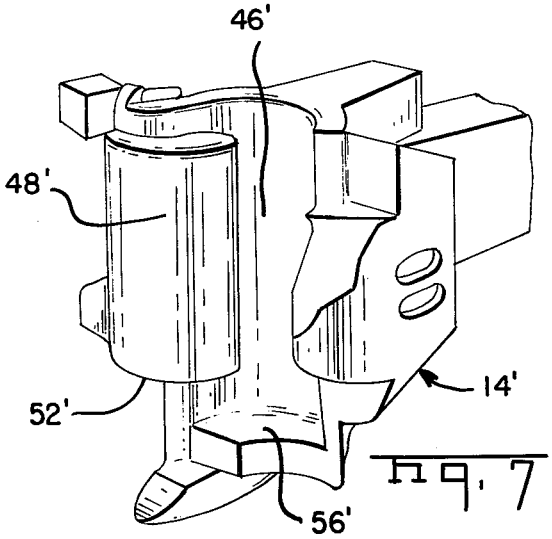
FIG. 7 is a perspective view of an f-type railroad car coupler.

Referring to FIG. 7, there is seen an f-type coupler 14′ having central hollow 46′, coupler knuckle 48′ which has a bottom 52′ and a lower shelf 56′.

Having described each of the individual elements of an apparatus constructed in accordance with the invention, the operation and performance of the method of this invention when used in conjunction with a railroad car equipped with an e-type coupler will be obvious to those skilled in the art from the following discussion. In operation, coupling device 28 is releasably secured to vertically displaceable forklift carriage 18 of forklift truck 16 by placing upper member 24 in upper transverse groove 42 and lower member 22 in lower transverse groove 44, all as shown in FIGS. 1 and 5. Forklift truck 16 is then maneuvered to position between the railroad track opposite railroad car 10 with coupler device 28 in general alignment with railroad car 14 as shown in FIG. 1. The level of the forklift attachment is then lowered such that coupling adaptor 28, and especially the uppermost portion of cylindrical member 34 is lower than the bottom 52 of knuckle 48. Forklift truck 16 is then maneuvered toward railroad car coupler 14 until cylindrical member 34 is beneath and in general alignment with central hollow 46 of the railroad car coupler 14. Once such general alignment is obtained, the forklift apparatus is slowly actuated to raise the forklift carriage and thereby cylindrical member 34 is raised generally within opening 46. Triangular alignment wing 36 will subsequentially contact the interior wall of opening 46 bringing knuckle portion 48 into alignment with cylindrical coupling pin 34. As the height of coupling adaptor 28 is raised, the point of contact between the alignment wing 36 and the wall of opening 46 will gradually descend along the downwardly sloping side of wing 36 until outermost extremity 50 is reached thereby causing cylindrical member 34 to be retained in alignment behind knuckle 48 and causing load-bearing member 32 to be retained beneath knuckle 48. Once such specific alignment has been attained the level of forklift device 18 is raised until the lower most extremity 52 of knuckle 48 contacts the uppermost portion 54 of second rectangular member 32. Such contact having been made, the level of coupling apparatus 28 is raised sufficiently to bring a portion of the weight of the railroad car to bear, through coupling adaptor 28 and forklift carriage 18, on to the driving wheels of forklift truck 16. By subsequently actuating the driving wheels of the forklift truck, the railroad car may be moved to its desired location within the railroad yard. Forklift truck 16 may then be un-coupled from railroad car 10 by reversing the procedure formerly described, and the truck moved to a separate part of the yard for the movement of other railroad cars.

In order to use coupling adaptor 28 with an f-type coupler having a lower shelf, adaptor 28 is positioned exteriorly of the f-type coupler 14' and in general horizontal alignment with the central opening 46' thereof, such that the bottom of coupling pin 34 and load-bearing member 32 are at a level above that of shelf 56' and that the upper load-bearing edge 54 of load-bearing member 32 is beneath the level of the bottom 52' of knuckle 48'. Knuckle 48' is then outwardly pivoted to an open position and coupling adaptor 28 moved toward coupler 14' until coupling pin 34 is within central hollow 46'. Knuckle 48' is then inwardly pivoted to a closed position and locked therein thereby confining coupling pin 34 inwardly of central hollow 46' and adjacent knuckle 48'. In so doing, upper load-bearing edge 54 of member 32 will be oriented directly beneath bottom 52' of knuckle 48'.

In order to move the railroad car, the lifting carriage 18 is raised as before until a portion of the weight of the car is transferred to the driving wheels of the forklift truck sufficient to provide the necessary traction.

In general, the coupling adaptor is preferably fabricated from a metal such as iron or steel, but any material capable of withstanding the lifting and pulling force would be suitable. The adaptor is preferably fabricated using between 1 inch and 1½ inches thick iron or steel plate for the first and second vertical plates and the vertical height of the load-bearing second vertical plate is between about 2 inches and about 4 inches. The coupling pin may be between about 8 inches and 10 inches in height and between about 1 inch and 2 inches in diameter. The length of elongated alignment bar 38 is preferably maintained at between about 5 inches and about 10 inches and the horizontal distance from the apex 50 of alignment wing 36 to coupling pin 34 between about 3½ inches to about 5½ inches. Furthermore, a series of 4 × 6 pieces of lumber may be positioned along the railroad ties to give the forklift truck a smooth "road" over which to drive. Finally, should the particular make or model of forklift truck fail to include horizontal support members which are suitable for interconnection of the coupling device, the carriage may, of course, be modified by the addition of such members thereto in order to provide a suitable mounting site for the device.

As will be appreciated by those skilled in the art, the practice of the method of this invention by use of the apparatus herein disclosed will allow the movement of a much greater tonage of railroad cars than would be obvious by virtue of the fact that a small, but significant, portion of the weight of a railroad car is brought to bear upon the driving wheels of the forklift, thereby imparting a significant increase in traction available to the forklift truck. In addition, the preferred use of an alignment wing such as wing 36 allows a connection between coupling adaptor 28 and railraod car coupler 14 which retains a degree of flexibility in that couple yet maintains the main pulling connection between cylindrical member 34 and coupler knuckle 48 and eliminates the possibility of slippage.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A load-bearing coupling adaptor for connecting a vertically displaceable carriage of a fork-lift truck, said carriage including a horizontal rigid support member and said carriage carrying fork members attached to their inner end portions thereto and disposed below said support member, to a coupler of a railroad car, said coupler having a central hollow and a locking pivotable knuckle pivotally mounted to one side of said coupler, comprising:

a. means for mounting to said horizontal support member of said carriage;

b. a coupling pin for engaging said coupler, said pin having an upper end; and c. a load bearing member disposed above said inner end portions of said fork members, a first end of said load-bearing member rigidly connected to said means for mounting and said load bearing member extending outwardly therefrom and terminating in a second end which second end rigidly mounts said elongated coupling pin below its said upper end, the distance between said first and second ends being sufficiently great to accommodate such knuckle between said pin and said means for mounting and sufficiently small that said pin is disposed adjacent said carriage and above said inner end portions of said fork members.

2. The coupling adaptor as set forth in claim 1 additionally comprising an alignment wing rigidly mounted to and extending laterally from said elongated coupling pin in a direction perpendicular to said load bearing member.

3. The coupling adaptor as set forth in claim 2 wherein said load-bearing member extends substantially horizontally from said means for mounting and has an upper load-bearing side and a lower side.

4. The coupling adaptor as set forth in claim 2 wherein said alignment wing is a generally vertically upstanding planar triangular plate having a first side rigidly mounted to the upper portion of said coupling pin, a second side extending generally outwardly and downwardly and a third side extending generally outwardly and upwardly, said second and third sides intersecting to form an apex, said apex adapted to contact said coupler interiorly of said central hollow thereof at a point therein generally opposite the side of said coupler pivotally carrying said knuckle.

5. The coupling adaptor as set forth in claim 2 wherein said means for mounting comprises a first vertically upstanding plate having a top edge, a bottom edge, a carriage-facing edge, a coupler-facing edge and two opposite side faces, said plate having a first transverse carriage-mounting groove in said bottom edge of said plate adjacent said carriage-facing edge, said groove being adapted and arranged to receive said horizontal support member.

6. The coupling adaptor as set forth in claim 2 wherein said wing has an upper edge extending inclinedly outwardly and downwardly with respect to said pin.

7. The coupling adaptor as set forth in claim 1 wherein said load bearing member extends substantially horizontally between its end and has an upper load-bearing side and a lower side, and wherein said coupling pin has a lower end co-extensive with the lower side of said load-bearing member.

8. The coupling adaptor as set forth in claim 1 wherein said means for mounting comprises a first vertically upstanding plate having a top edge, a bottom edge, a carriage-facing edge, a coupler-facing edge and two opposite side faces, said plate having a first transverse carriage-mounting groove in said bottom edge of said plate adjacent said carriage-facing edge, said groove being adapted and arranged to receive said horizontal support member.

9. The coupling adaptor as set forth in claim 8 wherein said load-bearing member is unitary with said first vertically upstanding plate.

10. The coupling adaptor as set forth in claim 8 wherein said carriage has a second horizontal support member in superposed position to said first horizontal support member and spaced a distance thereabove and wherein said first upstanding plate has a second transverse carriage-mounting groove in the top edge thereof, said second groove being adapted and arranged to receive said second horizontal support member.

11. The coupling adaptor as set forth in claim 10 additionally comprising an elongated alignment bar rigidly mounted at a point intermediate the length of said bar to said top edge of said first upstanding plate immediately adjacent a side of the transverse groove in said top edge, said alignment bar extending substantially normal to the plane of said first upstanding plate.

* * * * *